US005579575A

United States Patent [19]

Lamome et al.

[11] Patent Number: 5,579,575

[45] Date of Patent: Dec. 3, 1996

[54] METHOD AND APPARATUS FOR FORMING AN ELECTRICAL CONNECTION

[75] Inventors: Alain Lamome, Pierrelaye; Jacques Delalle, Triel sur Seine; Sylvain Briens, Soisy Sous Montmorency, all of France

[73] Assignee: Raychem S.A., France

[21] Appl. No.: 307,727

[22] PCT Filed: Mar. 30, 1993

[86] PCT No.: PCT/GB93/00658

§ 371 Date: Sep. 23, 1994

§ 102(e) Date: Sep. 23, 1994

[87] PCT Pub. No.: WO93/20596

PCT Pub. Date: Oct. 14, 1993

[30] Foreign Application Priority Data

Apr. 1, 1992 [GB] United Kingdom ..... 9207174

[51] Int. Cl.[6] ..... H01R 43/02; H05B 3/02

[52] U.S. Cl. ..... 29/860; 29/872; 174/88 C; 174/DIG. 8; 219/476; 219/605; 228/227

[58] Field of Search ..... 29/872, 860; 174/88 C, 174/DIG. 8; 264/230; 228/227; 219/476, 605

[56] References Cited

U.S. PATENT DOCUMENTS

| | | |
|---|---|---|
| 4,304,959 | 12/1981 | Vidakovits et al. . |
| 4,575,618 | 3/1986 | Rosenzweng . |
| 4,654,473 | 3/1987 | Roux et al. . |
| 4,722,471 | 2/1988 | Gray et al. . |
| 4,852,252 | 8/1989 | Ayer . |
| 4,914,267 | 4/1990 | Derbyshire . |
| 4,995,838 | 2/1991 | Ayer et al. . |
| 5,093,545 | 3/1992 | McGaffigan . |
| 5,107,095 | 4/1992 | Derbyshire . |
| 5,167,545 | 12/1992 | O'Brien et al. . |
| 5,189,271 | 2/1993 | Derbyshire . |
| 5,378,855 | 1/1995 | DeLalle . |

FOREIGN PATENT DOCUMENTS

| | | |
|---|---|---|
| 0159945 | 10/1985 | European Pat. Off. . |
| 0371458 | 6/1990 | European Pat. Off. . |
| 0371455 | 6/1990 | European Pat. Off. ..... H01R 4/72 |
| 0405561 | 1/1991 | European Pat. Off. . |
| 0420480 | 4/1991 | European Pat. Off. ..... H01R 43/02 |
| 57-45025 | 3/1982 | Japan . |
| 4-247930 | 9/1992 | Japan . |
| WO90/03090 | 3/1990 | WIPO . |
| WO92/00616 | 1/1992 | WIPO . |

*Primary Examiner*—Carl J. Arbes

*Attorney, Agent, or Firm*—Herbert G. Burkard; Sheri M. Novack

[57] ABSTRACT

A method and apparatus of forming a solder connection between a plurality of elongate bodies, comprises:

(i) forming an initial connection between the elongate bodies by inserting them into an induction heatable connecting element of a connector, the connector comprising a dimensionally heat-recoverable sleeve and, retained within the sleeve, the connecting element and a solder insert that is in thermal contact with the connecting element; and (ii) heating the connector (a) by subjecting the connecting element to an alternating magnetic field so that it is heated by induction thereby melting the solder insert, and (b) subjecting the sleeve to hot air and/or infrared radiation, thereby causing the sleeve to recover.

The apparatus for applying heat to an elongate connector, comprises a first heat source which comprises an induction coil, and a second heat source arranged to generate hot air or infrared radiation.

8 Claims, 3 Drawing Sheets

METHOD AND APPARATUS FOR FORMING AN ELECTRICAL CONNECTION

This invention relates to the formation of connections between elongate bodies, particularly electrical connections and especially connections between electrical wires and cables.

In many instances it is desired to form a solder connection between two or more wires. This can, for example be achieved by means of solder connection devices comprising a small dimensionally heat-recoverable sleeve which contains a quantity of solder. The wires can be inserted into the sleeve after the ends have been stripped of insulation, and the device can then be heated, for example by means of a hot-air gun or by an infrared lamp, to recover the sleeve about the wires and to melt the solder inside the sleeve. A device for forming such a solder connection is disclosed in International Patent application publication No. WO92/00616, the disclosure of which is incorporated herein by reference. That device comprises a metallic connecting element in the form of a tapering helical coil of wire located in a dimensionally heat-recoverably sleeve, and a quantity of solder. The device enables a temporary or initial electrical connection to be formed by screwing the device onto the wires and then, for example after the connection has been electrically tested, the device can be heated to form a permanent electrical connection. By means of such devices it is possible to form very reliable solder joints which are sealed against ingress of moisture. However in many cases a degree of skill is required on the part of the operator in order to ensure that the solder is fully melted but at the same time to prevent overheating of the wire insulation the heat-recoverable sleeve or the like.

Self-regulating induction heating has been used in an attempt to prevent overheating. For example, European patent application, publication No. 0371458 discloses a method of terminating an electrical wire at a connector assembly, in which the connector terminal, comprising a solder tail, has a thin layer of a self-regulating heating source bonded to it. The self-regulating heating source comprises a foil having a first layer of copper or copper alloy which has a low resistance and minimal magnetic permeability, and a second thin layer of magnetic material such as nickel-iron alloy. The electrical wire is terminated by placing a stripped end of the wire over the solder tail. An alternating magnetic field is then applied to the self-regulating heating source, at a frequency of 13.56 MHz for example, causing the solder tail to heat up and melt the solder and cause the sleeve to shrink. Because the heating source is self-regulating, it may be heated to a pre-selected maximum temperature sufficient to melt the solder and shrink the sleeve.

European patent application No. 0420480 discloses an alternative method of terminating an electrical wire at a connector assembly, wherein a self-regulating induction heater preform comprising a band of bipartite metal having a first layer of non-magnetic metal, e.g. copper, and a second layer of high magnetic permeability metal, e.g. an alloy of nickel and iron, is crimped around a stripped end of the wire to be terminated. A heat-recoverable sleeve containing a solder preform is then installed on a connector terminal and the stripped end of the wire which has the band of bipartite metal crimped on it is inserted into the sleeve. The bipartite metal band is then heated by induction by placing an inductance coil around the sleeve and applying a high frequency alternating current, e.g. 13.56 MHz in the coil. The heating of the bipartite metal band causes the solder preform to melt and the sleeve to recover. Optionally, a preliminary assembly step may be carried out, whereby the heat-recoverable sleeve is pre-installed on the connector terminal by applying a limited amount of heat to a leading end of the sleeve to cause the leading end to recover about part of the terminal.

A further method of using self-regulating induction heating to form a soldered electrical connection is disclosed in European patent application, publication No. 0405561. In this method, the self-regulating induction heater comprises a preform that is either wrapped around or against a solder preform within a length of heat-recoverable tubing. The heater preform is formed from a first layer of copper or copper alloy having a thickness of for example 0.05 mm and a second layer of magnetic material such as nickel-iron alloy having a thickness of 0.01 mm to 0.015 mm for example. The preform is formed as a thin layer and preferably has a spiral shape so that it is easily reduceable in diameter to permit the sleeve of heat-recoverable tubing to reduce in diameter upon being heated to its recovery temperature.

European patent application, publication No 0371455 discloses a different approach to self-regulating induction heating. In this approach, a heat-recoverable sleeve containing a solder preform is heated by means of a self-regulating heater strap which is wrapped around the sleeve. The strap comprises a first layer of copper or copper alloy having a thickness of for example 0.05 mm and a second layer of magnetic material such as nickel-iron alloy having a thickness of for example 0.01 mm to 0.015 mm. The strap is heated either by induction or by direct application of an alternating current, and the heat generated in the strap melts the solder preform and causes the sleeve to recover. This approach may sometimes be used to seal solder tails of the type disclosed in EP0371458 when the tails are not used to terminate an electrical wire. In this case, the strap may be used to heat and shrink an end region of the sleeve which is not located around the solder tail and the solder tail may be heated by induction in order to heat and shrink the part of the sleeve that is located over the solder tail.

The use of induction, however, as a means of heating solder connection devices has a problem in that the degree to which the various components of the device are heated depends on the nature of the components themselves as well as the induction heating source. For example the frequency of the power source that is needed in order to raise the elongate bodies, e.g. copper wires, to the required temperature is not the same as that needed to melt the solder or to recover the sleeve. This can be seen by considering the skin depth which is given by the relationship $$\delta = 250\left(\frac{\rho}{\mu f}\right)^{1/2}$$

where $\delta$ is the skin depth measured in metres, $\rho$ is the resistivity of the component considered, $\mu$ is its relative magnetic permeability and $\mu$ is the frequency of the ac field of the work coil. Thus, as the resistivity and magnetic permeability of the various components differ, the skin depth will differ and will not normally match the physical thickness of the components.

According to one aspect of the present invention, there is provided a method of forming a solder connection between a plurality of elongate bodies, which comprises:

(i) forming an initial connection between the elongate bodies by inserting them into an induction heatable connecting element of a connector, the connector comprising a dimensionally heat-recoverable sleeve and, retained within the sleeve, the connecting element and a solder insert that is in thermal contact with the connecting element; and (ii) heating the connector (a) by subjecting the connecting element to an alternating magnetic field so that it is heated by induction, thereby melting the solder insert, and (b) subjecting the sleeve hot air and/or infrared radiation, thereby causing the sleeve to recover.

According to another aspect of the invention, there is provided an apparatus for applying heat to an elongate connector, comprising (i) a first heat source comprising an induction coil arranged to generate an alternating magnetic field, and (ii) a second heat source arranged to generate hot air or infrared radiation, wherein (iii) the first source is disposed around a first portion of the connector, and wherein (iv) the second source comprises a hollow rigid component that is arranged to surround a second portion of the connector that is longitudinally spaced apart from said first portion of the connector.

The method and apparatus according to the present invention have the advantage that it is possible for the heat-recoverable sleeve and other components of the connector with greatly differing physical and electrical properties to be heated by the correct amount during formation of the connection. A problem associated with previous methods and apparatus for forming solder connections is that one or more of the different components of the connector are normally overheated in order to ensure that another of the components is heated sufficiently. For example, if only an external source of heating, e.g. hot air or infrared radiation, is used both to recover the heat-recoverable sleeve and to melt the solder, the recoverable sleeve will overheated because all of the heat required to melt the solder needs to pass through the sleeve. Overheating may, for example, degrade the properties of the sleeve and is in any case inefficient and time-consuming. Alternatively, however, if only an internal source of heating, e.g. by induction, is used the solder may be overheated because the thermal conduction from an internal heating element to the solder is much more rapid than conduction from the heating element to the extremities of the heat-recoverable sleeve or from the heating element along the elongate bodies, e.g. wires and through the wire insulation, to the extremities of the heat-recoverable sleeve. Overheating of the solder may cause the solder to 'wick' along the wires or 'squirt' out of the connector, thereby causing short circuits or 'dry' connections. In addition, overheating of the solder may cause overheating of the sleeve in the vicinity of the solder, and in any case is inefficient and time-consuming.

The present invention solves, or at least alleviates, the above problems associated with previous methods and apparatus, since it normally enables the correct amount of heat to be supplied to the solder in order to melt it and the correct amount of heat to be supplied to the sleeve in order to cause it to recover, substantially without overheating any component of the connector or, for example, the insulation of wires connected by means of the connector.

According to a preferred embodiment of the invention, the connector is heated by both the hot air and/or infrared radiation substantially simultaneously. This has an advantage in that not only is overheating of components of the connector normally avoided, but also the time taken to melt the solder and recover the sleeve can normally be reduced significantly in comparison to conventional methods, due to the two sources of heat complementing each other.

The present invention is especially advantageous for forming a solder connection by means of a connector which has part of its dimensionally heat-recoverable sleeve extending beyond at least one end of the connecting element. In this case, heating the connector solely by induction can be inefficient and time-consuming since the further the sleeve extends away from the connecting element, the less efficient and more time-consuming is the transfer of heat from the connecting element to the end of the sleeve. Hence, according to a preferred aspect of the invention, the hot air and/or infrared radiation is applied to a portion of the sleeve which is longitudinally spaced apart from a portion of the sleeve which retains the connecting element, which is heated by induction.

The connecting element of the connector which is used to form the solder connection may be formed from substantially non-magnetic material, for example copper and particularly hard temper copper. Preferably, however, the connecting element is formed from high magnetic permeability material. The phrase "high magnetic permeability material" is intended to mean a material having a relative magnetic permeability, at low H fields, of at least 5, more preferably at least 10 and especially at least 100, but will often be 1000 or more. The connecting element is normally hollow and open-ended so that the ends of the bodies can be inserted therein, and preferably has a screw-threaded interior so that they can be screwed into it and will then be temporarily held therein. The connecting element may be made in a number of ways and from a number of materials. The heat may be generated in the element by hysteresis losses or by eddy current losses or by both mechanisms depending on the material from which the element is formed. For example the element may be formed from a conductive, substantially non-magnetic material such as copper, or a ferromagnetic material such as low carbon steel, in which case the heating effect will be caused by eddy current losses, or it may be formed from a ferrimagnetic material such as a ferrite in which case the heating effect will be due to hysteresis losses.

The connecting element can be made from a wire by coiling it up, normally into a frusto-conical configuration so that the wire itself provides the screw thread on the interior of the element. In this case the wire forming the element may be provided with a pair of flat faces extending along its length that join to form a ridge, for example it may have a polygonal cross-section, to make the screw thread more pronounced. Such an element would have a form generally as shown in international patent application No. WO/9200616. This form of element, as can others, may be formed from materials such as copper or steel, especially low carbon steel, or from ferritic stainless steel. Alternatively, the element may be formed from a solid block, for example a machined block or formed by other methods, in which case it may be formed from a metal as described above or from a non-metallic high permeability material such as a sintered ferrite, especially one having a Curie temperature in the range of from 225° to 250° C. Such a material has the advantage that it enables the heating method to heat the article to a temperature in the region of the Curie temperature, so causing the solder to melt (eg. an $Sn_{63}$ $Pb_{37}$ eutectic will have a melting point of 183° C.) but the heating efficiency will fall off rapidly at temperatures above the Curie point of the element and thereby limit the temperature rise of the article to one governed by the Curie point of the element. If it is desired to improve the degree of control over the heating step, it is often possible to monitor the reduction of the magnetic field strength in the region of the connecting element as the element passes through its Curie temperature and to use this reduction to control the termination of the heating step, eg. by stopping power to the heating coil.

According to the invention the recoverable sleeve will recover, and any sealant will fuse, principally due to the effect of the hot air and/or infrared radiation, whereas the copper conductors to be connected will be heated almost entirely by thermal conduction from the connecting element. In most instances the solder will be heated principally by thermal conduction from the connecting element although a significant amount of heating of the solder may occur due to the hot air or infrared heater. Where the connecting element is in the form of a coil, the solder will flow through the windings of the coil into its interior and so connect the conductors with the element, and if the element is formed from a solid block of material, it will be necessary to form a number of holes in the element to allow the solder access to the interior of the element.

As stated above the sleeve is dimensionally heat-recoverable, that is to say the article has a dimensional configuration that may be made substantially to change when subjected to heat treatment. Usually these articles recover, on heating, towards an original shape from which they have previously been deformed but the term "heat-recoverable", as used herein, also includes an article which, on heating, adopts a new configuration, even if it has not been previously deformed.

In their most common form, such articles comprise a heat-shrinkable sleeve made from a polymeric material exhibiting the property of elastic or plastic memory as described, for example, in U.S. Pat. Nos. 2,027,962; 3,086, 242 and 3,597,372. As is made clear in, for example, U.S. Pat. No. 2,027,962, the original dimensionally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat-unstable form in a separate state.

In the production of heat-recoverable articles, the polymeric material may be cross-linked at any stage in the production of the article that will enhance the desired dimensional recoverability. One manner of producing a heat-recoverable article comprises shaping the polymeric material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its original heat-stable shape.

Any material to which the property of dimensional recoverability may be imparted may be used to form the sleeve. Preferred materials include low, medium or high density polyethylene, ethylene copolymers, eg. with alpha olefins such as 1-butene or 1-hexene, or vinyl acetate, polyamides or fluoropolymers, eg. polytetrafluoroethylene, polyvinylidine fluoride or ethylene-tetrafluoroethylene copolymer.

The solder employed in the connector is a soft solder as distinct from brazing material. The solder may, for example, simply be in the form of an $Sn_{63}Pb_{37}$ eutectic composition which will melt as the device is heated and the sleeve recovers, or more than one solder composition having differing melting points may be employed, as described in International Application No. WO88/09068. In this form of device, melting of the higher melting point component, eg. $Sn_{96.5}A_{g3.5}$ eutectic will provide a visual indication that the device has been heated sufficiently to melt the lower melting point composition and to form a satisfactory solder joint. If desired the lower melting point solder may be a non-eutectic composition and, for example as described in International Application No. WO90/09255, the higher and lower melting point solder compositions may together form a eutectic composition. For example, a non-eutectic $Sn_{60}Pb_{40}$ lower melting point component may be employed with a higher melting point component formed from pure tin in relative amounts that an $Sn_{63}Pb_{37}$ eutectic is formed. The disclosures of these two patent applications are incorporated herein by reference. An advantage of employing a two component solder, and especially a tin, $Sn_{60}Pb_{40}$ combination is that it reduces the possibility of "wicking" that is to say, travel of the solder along the conductors and away from the joint area due to capillary action by the stranded conductors, which can be caused by prolonged heating of the device.

The solder may be positioned anywhere where it will be able to flow into the connecting element to form a solder joint and where it is in good thermal contact with the element. The solder may be employed in the form of a ring or in any other form for example a ball, and may be disposed symmetrically about the sleeve axis or offset from it. The solder element may, for instance, be located at the smaller diameter end of a frusto-conical connecting element in which case it may be in the form of a ball or plug, or it may be located in the region of a large diameter end of the connecting element, for example in the form of a ring. Preferably the solder is in the from an element that surrounds the connecting element, especially where the connecting element is in the form of a coil so that the fused solder can flow through the windings of the coil to the interior thereof. More than one quantity of solder may be employed, for example where the connecting element has more than one tapering internal surface for forming a splice.

The hot air and/or infrared heating step may be carried out before or after the induction heating step or simultaneously therewith. If the two heating steps are carried out simultaneously the hot air gun or infrared lamp may be incorporated into the induction heating coil.

The infrared heating source may be provided by a hollow rigid component which can be excited by an induction coil if chosen of suitable material. It may be convenient to use a single source of induction heating by combining the induction coil of the infrared heating source with a coil that is used to heat the connecting element. In this arrangement the entire heating of the connector and the connection may be carried out substantially simultaneously.

As mentioned above, the second heat source of the apparatus according to the invention comprises a hollow rigid component. According to a preferred embodiment of the apparatus according to the invention, the second heat source is arranged to be heated by induction, and once heated, to generate infrared radiation. It is particularly preferred that the second heat source is arranged to be heated by the first heat source. This has the advantage that only one source of power is needed to heat an article both by induction and by infrared radiation.

Depending on the particular requirements and the composition of the connector, the hollow rigid component may be formed from any of a variety of different materials and may have any of a number of different forms. For example, for certain applications the component may be formed from a material of high magnetic permeability, e.g. a ferrite or low carbon steel, but for other applications, the element may be formed from substantially non-magnetic material, e.g. copper. The choice of material which best suits the particular requirements will normally be made on a trial and error basis. Also depending on the particular requirements, the component may, for example, have a substantially cylindrical or conical shape, or it may comprise at least one coil.

In addition to the method and apparatus, the present invention also provides a solder connection between a plurality of elongate bodies that has been formed by the method according to the invention.

The method and apparatus according to the present invention will now be described by way of example with reference to the accompanying drawings in which.

Figure 1:
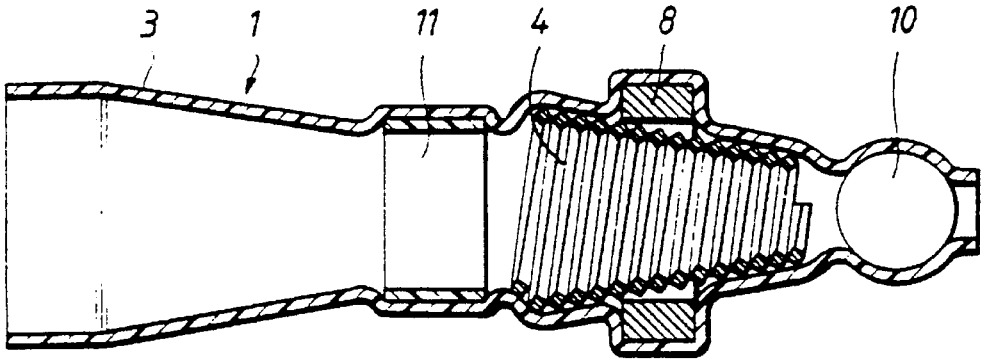
FIG. 1 is a side sectional elevation of a connector that is employed in the present invention.

Referring to the accompanying drawings, FIG. 1 shows a connector for forming a solder joint between a number of electrical wires 2 which comprises a dimensionally heat-recoverable sleeve 3 formed from crosslinked and expanded polyvinylidine fluoride, and a connecting element 4 formed as a frusto-conical spring or coil of low carbon steel wire. The steel wire can have a cross-section for example in the form of a square or a rhombus in which sides, forming faces on the wire, are arranged at an angle of approximately 60° to one adjacent side and at an angle of approximately 120° to the other adjacent side. The wire is coiled up so that the ridges formed by the faces that are at 60° to each other are located on the interior and the exterior of the element, the interior ridge forming a screw thread for holding the wires to be connected. One end of the wire located at the smaller diameter end of the connecting element 4 is bent so that it extends across the axis of the coil and prevents over insertion of the conductors to be connected. In some instances it may be advantageous to expand the diameter of the coil 4 by opening out the ends of the copper wire 5 and retaining them in their new position.

A ring 8 of $Sn_{63}Pb_{37}$ eutectic solder is located about the external surface of the connecting element 4 between the connecting element and the heat-shrinkable sleeve 3. As shown, the solder ring is relatively thick and short, its axial length being only approximately twice its radial thickness, although in many instances it may be desirable for the ring to be thinner and longer in order to improve the thermal contact with the connecting element.

One end of the sleeve in the region of the smaller diameter end of the connecting element is pre-recovered onto a spherical sealing element 10 formed from a fusible polymeric material, eg. polyethylene, and a further sealing element 11 in the form of a ring is located within the sleeve adjacent to the other end of the connecting element 4.

In order to form an electrical connection between the wires 2 in a bundle, their ends are stripped of insulation and inserted into the open end of the connector 1 until they abut the end of the end of the wire 5 that has been bent across the axis of the coil and acts as a stop. The connector 1 is then given a small twist to screw the wires 2 into the connecting element 4 and hold the connector on the wires. The wires and connector are then both inserted into an induction heating coil 12 which is powered up. During this process the connecting element heats up and causes the solder ring 8 to melt and flow through the windings of the coil to its interior and so form a solder bond between the wires and the connecting element.

Simultaneously with the induction heating step, the device is briefly heated externally with hot air by means of a hot air gun 13. The temperature, flow rate and heating cycle time of the hot air gun is set so that the hot air will not, on its own, melt the solder ring 8, but it will cause the heat-recoverable sleeve 3 to shrink about the wires and the sealing ring 11 to melt. A stub splice that is sealed against moisture ingress is thereby formed.

Figure 3:
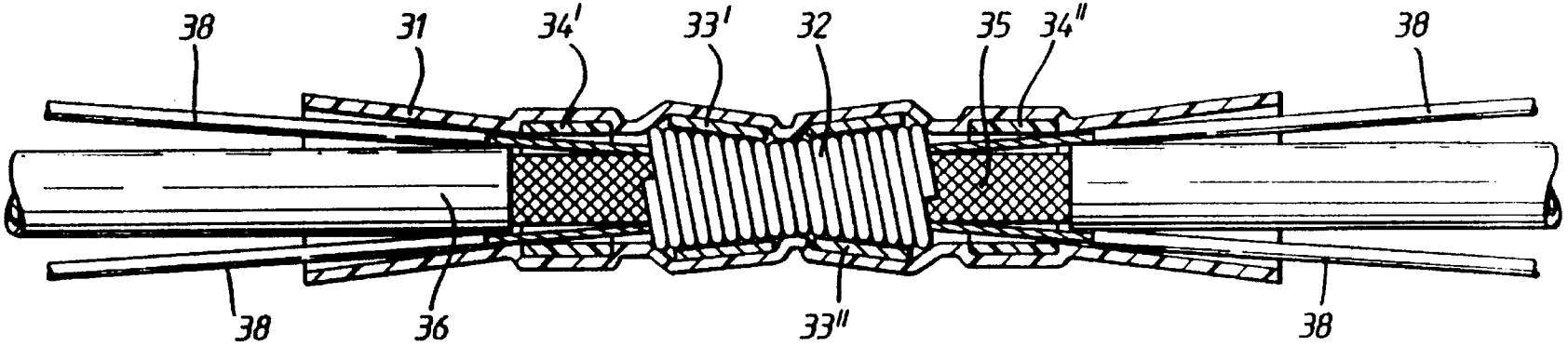
FIG. 3 is a side sectional elevation of a second form of connector.

FIG. 3 shows a form of connector according to the invention of the form described in International patent application No. PCT/GB92/02257 for connecting one or more ground leads to the shield of a coaxial cable. This form of connector comprises a heat-recoverable polyvinylidine fluoride sleeve 31 that contains a generally diabolo shaped connecting element 32 wraps of fluxed $Sn_{63}Pb_{37}$ eutectic solder 33' and 33", and a pair of fusible polyethylene sealing rings 34' and 34", one sealing ring being located at each end of the connecting element 32. As described above, the connecting element has been formed from by coiling a low carbon steel wire that has a square cross-section.

Figure 2:
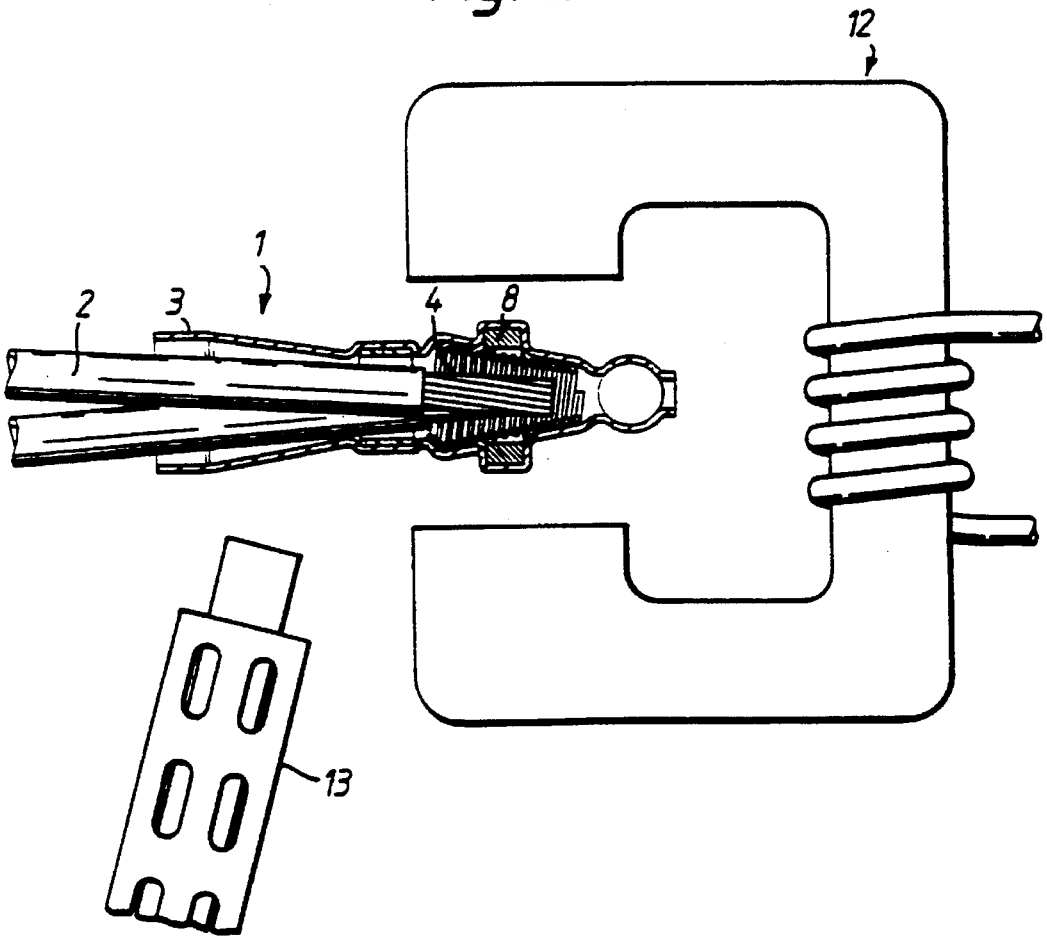
FIG. 2 is a side section view of the connector of FIG. 1 together with wires during the heating step.

In use a central portion of the outer jacket 35 of a coaxial cable 36 is removed in order to expose a portion of the braid 37 forming the screen. One or more ground leads 38 can be inserted into one open end of the connecting element 32 and the element 32 can then be twisted about the coaxial cable 36 and the ground lead in order to grip the ground lead. The connector can be heated by means of an induction coil and hot-air gun as described in FIGS. 1 and 2 to form a sealed splice.

The connecting element 32 is capable of expanding at its waist if necessary in order to fit over coaxial cables of a range of diameters, the maximum diameter being determined by the size of the chamber formed by the central section 38 of heat-recoverable sleeve 31. Provision of the solder 33 in the form of wrap will allow the solder to accommodate any increase in size of the connecting element.

Figure 5:
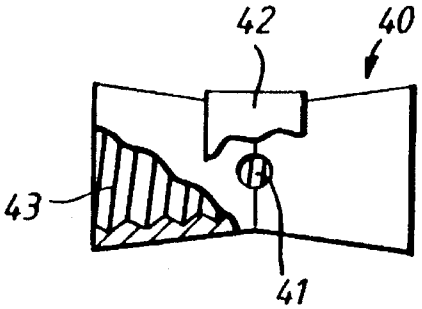
FIGS. 4 and 5 are partially cut-away views of alternative forms of connecting element.
Figure 4:
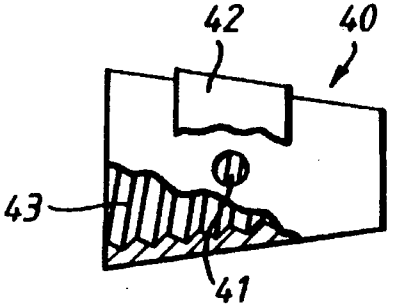

FIGS. 4 and 5 show two further connecting elements and solder rings that may be employed in connectors used in the present invention. This form of element 40, frusto-conical as shown in FIG. 4 and diabolo as shown in FIG. 5 are formed from a sintered ferrite, eg. a Mn Ni or Ni Zn ferrite having a Curie point between 200° and 250° C. The elements 40 are formed by moulding or machining solid bodies of the ferrite. Usually it will be necessary for holes 41 to be provided in the elements in order to enable the solder 42 to flow into the interior of the element after fusing. The elements 40 may be provided with teeth or a screw thread 43 on their interior surface in order to allow the elements to grip the stripped wire ends that are to be connected by a simple twisting action as described above. These forms of connecting elements may be employed in connectors as shown in FIGS. 1 and 3 exactly as described above with the exception that the rate at which the elements 40 will generate heat will fall considerably as the element passes through its Curie temperature, so that the risk of overheating in the induction heating step is reduced.

Figure 6:
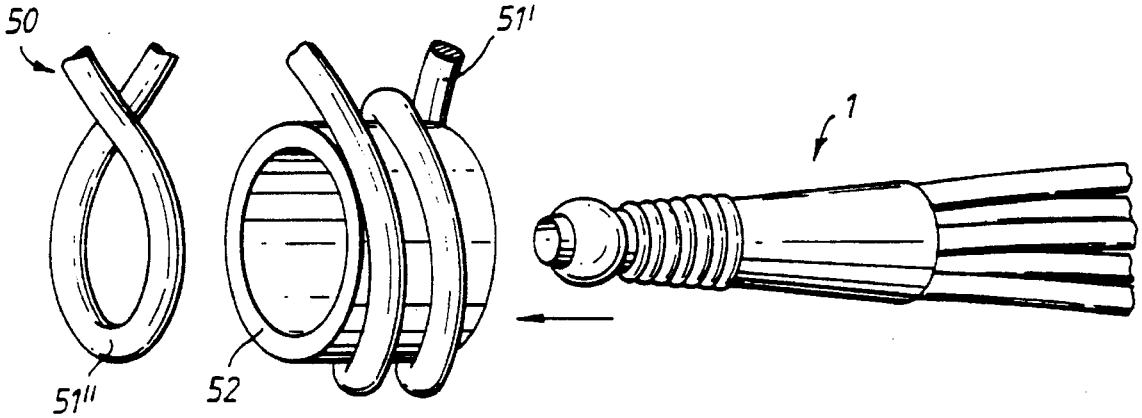
FIGS. 6 and 7 are schematic representations of one form of apparatus according to the invention, showing a connector being inserted into the apparatus and heated.

FIG. 6 is a schematic representation of the connector 1 prior to being inserted into a hollow rigid component 52 and induction coils 51' and 51" of heating apparatus 50. The induction coils 51' and 51" may comprise separate coils or they may be parts of a single coil. The component 52 comprises a substantially cylindrical component located inside the induction coil 51'.

Figure 7:
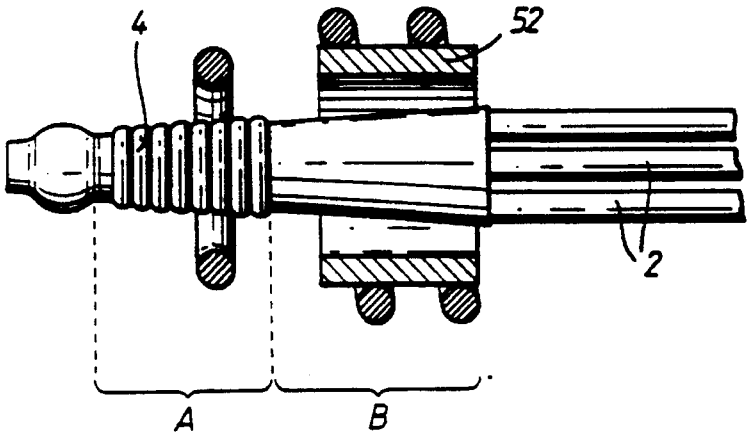

FIG. 7 shows the connector 1 disposed in the apparatus 50 and after the connection has been made. To achieve this an alternating current has been passed through the induction coils 51' and 51", which has generated an alternating magnetic field inside the coil. The alternating magnetic field heated the connecting element 4 in a first heating zone A by induction in the coil 51", and thermal conduction from the connecting element has melted a solder ring 8 (shown in FIG. 1). The alternating magnetic field generated by the coil 51' has heated the hollow rigid component 52 by induction in a second heating zone B, which has caused the component to radiate infrared radiation, thereby heating the heat-recoverable sleeve 3 in the zone B and causing it to recover about the wires 2.

We claim:

1. A method of forming a solder connection between a plurality of elongate bodies, which comprises:

(i) forming an initial connection between the elongate bodies by inserting them into an induction heatable connecting element of a connector, the connector comprising a dimensionally heat-recoverable sleeve and, retained within the sleeve, the connecting element and a solder insert that is in thermal contact with the connecting element; and (ii) heating the connector (a) by subjecting the connecting element to an alternating magnetic field so that it is heated by induction thereby melting the solder insert, and (b) simultaneously subjecting the sleeve to at least one of hot air and infrared radiation, thereby causing the sleeve to recover.

2. A method as claimed in claim 1, wherein the hot air and/or infrared radiation is applied to a portion of the sleeve which is longitudinally spaced apart from a portion of the sleeve which retains the connecting element.

3. A method as claimed in claim 1, wherein the infrared radiation is applied to the sleeve by means of a heating element located outside the sleeve, which element is heated by induction.

4. A method as claimed in claim 3, wherein the alternating magnetic field that heats the connecting element is produced by an induction coil which also heats the heating element.

5. A method as claimed in claim 1, wherein the connecting element has an internal screw thread and the initial connection between the elongate bodies is formed by screwing the bodies into the connecting element so that they are held therein.

6. A method of forming a solder connection between a plurality of elongate bodies, which comprise:

(i) forming an initial connection between the elongate bodies by inserting them into an induction heatable connecting element of a connector, the connector comprising a dimensionally heat-recoverable polymeric sleeve and, retained within a longitudinal portion only of the sleeve, the connecting element and a solder insert that is in thermal contact with the connecting element; and (ii) heating the connector (a) by subjecting said longitudinal portion of the sleeve enclosing the connecting element to an alternating magnetic field so that the connecting element is heated by induction thereby melting the solder insert, and (b) simultaneously subjecting the sleeve beyond said longitudinal portion to at least one of hot air and infrared radiation, thereby causing the sleeve to recover.

7. An apparatus for applying heat to an elongate connector, comprising:

(i) a first heat source comprising an induction coil arranged to generate an alternating magnetic field, and (ii) a second heat source arranged to generate infrared radiation, wherein (iii) the first source is disposed around a first portion of the connector that encompasses an induction heatable connecting element, and wherein (iv) the second source comprises a hollow rigid component that is arranged to surround a second portion of the connector that encompasses a dimensionally heat-recoverable polymeric sleeve and that is longitudinally spaced apart from said first portion of the connector.

8. An apparatus as claimed in claim 7, wherein the second heat source is arranged to be heated by the first heat source.

* * * * *